United States Patent [19]

Kobayashi et al.

[11] 4,094,380

[45] June 13, 1978

[54] MULTI LAYER SOUND-PROOFING STRUCTURE

[75] Inventors: Hiroshi Kobayashi, Chofu; Nobuyoshi Kuwabara, Yokohama, both of Japan

[73] Assignee: Chiyoda Chemical Engineering & Construction Co., Ltd., Yokohama, Japan

[21] Appl. No.: 802,418

[22] Filed: Jun. 1, 1977

[30] Foreign Application Priority Data

Jun. 3, 1976 Japan ..... 51-64122

[51] Int. Cl.[2] ..... E04B 1/84

[52] U.S. Cl. ..... 181/285; 52/144; 181/290

[58] Field of Search ..... 181/285, 286, 290, 291, 181/294; 52/144, 145

[56] References Cited

U.S. PATENT DOCUMENTS

| | | | |
|---|---|---|---|
| 2,021,359 | 11/1935 | Halstead | 52/144 X |
| 2,220,349 | 11/1940 | Plumb | 52/144 |
| 2,271,929 | 2/1942 | Venzie | 52/145 |
| 2,340,535 | 2/1944 | Jenkins | 52/144 X |
| 2,915,135 | 12/1959 | Lemmerman | 181/290 |
| 3,866,001 | 2/1975 | Kleinschmidt | 52/145 X |
| 3,956,563 | 5/1976 | Spang | 181/290 |

FOREIGN PATENT DOCUMENTS

| | | | |
|---|---|---|---|
| 2,407,281 | 9/1974 | Germany | 181/290 |

*Primary Examiner*—N. P. Godici
*Attorney, Agent, or Firm*—Flynn & Frishauf

[57] ABSTRACT

A multi layered sound-proofing structure comprises: a first layer comprising a light aggregate and a binder and having a bulk density of from 0.1 to 2.0 g/cm$^3$ and void fraction as continuous void of from 15 to 60%; a second layer of a material having a quality to insulate relatively high frequency sounds and penetrate relatively low frequency sounds; a third layer comprising a light aggregate and a binder, the same as or different from those of the first layer and having a bulk density of from 0.1 to 2.0 g/cm$^3$ and void fraction as continuous void of from 15 to 60%, the first and second layers each overlying the third layer; and a fourth layer of a material having a high sound-insulating ability and covering all surfaces of a layered structure of said first, second and third layers except for the sound incident surface of said first layer. A perforated plate may be provided over the sound incident surface of the first layer with an air space therebetween.

9 Claims, 10 Drawing Figures

MULTI LAYER SOUND-PROOFING STRUCTURE

FIELD OF THE INVENTION

This invention relates to a sound-proofing structure and, more particularly, to a sound-proofing structure which has excellent sound-absorption ability for frequencies ranging from low frequencies to high frequencies.

BACKGROUND OF THE INVENTION

Recently, a social problem has developed involving various kinds of noises such as traffic noise by cars, etc., and noises from factories and the like. These noises are of a wide range of frequencies, as from several tens of hertz or several thousands of hertz.

Examples of conventional sound-absorbing materials are as follows: products comprising an aggregate such as sand, gravel, etc., and a binder such as a synthetic resin, an asphalt and the like, and products of glass fibers. However, these conventional sound-absorbing materials are not useful for absorption of noises of wide compass ranging from low to high frequencies, because some have sound-absorbing ability only for high frequencies and others only for low frequencies.

SUMMARY OF THE INVENTION

We have endeavored to overcome the above-described disadvantages and to develop novel sound-proofing materials having excellent sound-absorbing and sound-insulating ability for a wide range of frequencies, and characterized by light weight for easy handling. As a result, in accordance with the present invention, there is provided a sound-proofing structure comprising: a first layer comprising a light aggregate and a binder and having a bulk density of from 0.1 to 2.0 g/cm$^3$ and void fraction as continuous void of from 15 to 60%; a second layer of a material having a quality to insulate relatively high frequency sounds and penetrate relatively low frequency sounds; a third layer comprising a light aggregate and a binder, the same as or different from those of the first layer and having a bulk density of from 0.1 to 2.0 g/cm$^3$ and void fraction as continuous void of from 15 to 60%, the first and second layers each overlying the third layer; and a fourth layer of a material having a high sound-insulating ability and covering all surfaces of a layered structure of said first, second and third layers except for the sound incident surface of said first layer.

EMBODIMENTS OF THE INVENTION

Figure 1:
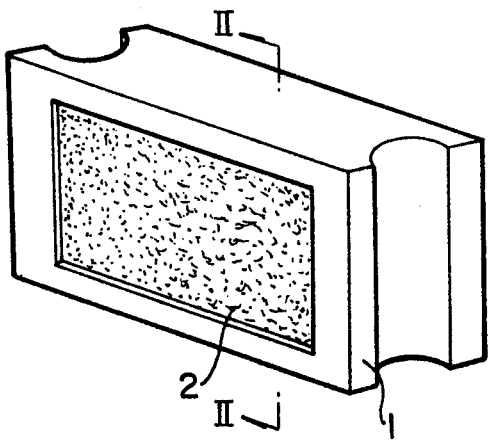
FIG. 1 is a perspective view showing one embodiment of the sound-proofing structure of the present invention.
Figure 2:
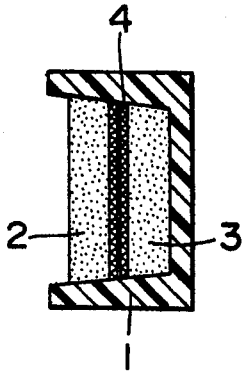
FIG. 2 is a cross-sectional view of said structure taken along line II—II in FIG. 1.

Referring to FIGS. 1 and 2, a structure of the present invention comprises a first layer 2 which is formed of a light aggregate and a binder, a third layer 3 which is also formed of a light aggregate and a binder, and a second layer 4 interposed between the first and third layers. The second layer is made of a material having a quality to insulate relatively high frequency sounds and penetrate relatively low frequency sounds. A fourth layer 1 is provided to cover all surfaces of the first, second and third layers except for the upper or outer surface of said first layer 2, as illustrated in FIGS. 1 and 2. Said upper or outer surface, i.e. the uncovered surface, is a sound incident one. The first, second and third layers preferably form a laminated assembly. The structure of FIG. 1 is illustrated as a building block with the fourth layer 1 being concrete, but, as will become apparent from the following detailed discussion, the structure may take other desired forms. The constituent elements of the first, second, third and fourth layers, 2, 4, 3 and 1, respectively, will be described in greater detail hereinbelow.

Figure 3:
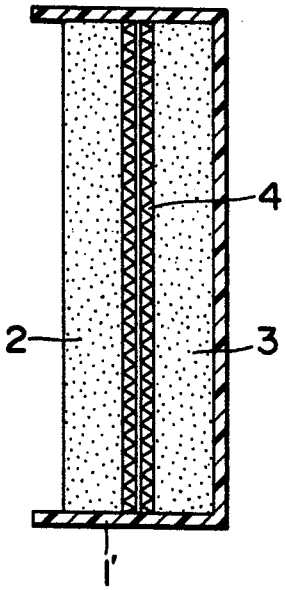
FIG. 3 is a cross-sectional view of a structure of the present invention, the fourth layer of which is a metal plate.

The arrangement of FIG. 3 is similar to that of FIGS. 1 and 2, except that the fourth layer 1 is shown as being formed of metal plates.

Figure 10:
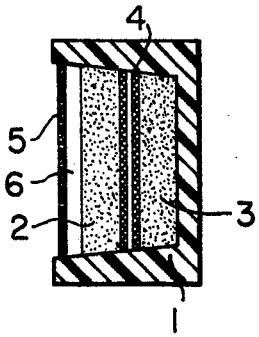
FIG. 10 illustrates a modification of the embodiment of FIGS. 1 and 2.

FIG. 10 shows a modified structure with a perforated plate 5 provided on the outer surface of the first layer 2 with an air layer 6 provided therebetween. This feature is discussed hereinbelow in the Examples.

The aggregate used in the first and third layers 2, 3, respectively, is preferably of light weight and easy to handle. It has a bulk density of from 0.1 to 2.0 g/cm$^3$, and void fraction as continuous void of from 15 to 60%. Materials used as a light aggregate are not limited in character; however, one or more substances selected from the group consisting of pearlite, synthetic light aggregates (for example, expanding-shale, etc.), pumice, volcanic gravel and vermiculite are preferably employed. Of course sand, gravel, etc. can be added to the above light aggregate as another aggregate. Particle size of the aggregate used in the first and the third layers 2, 3 is from 1 to 20 millimeters. When particle size of the aggregate is outside of this range, the sound-absorbing ability of the material is decreased remarkably.

A binder used in the first layer 2 or the third layer 3 is not limited, so long as it has sufficient ability to bind the aggregates thereof to each other. Preferred examples are one or a mixture of two or more selected from the group consisting of bitumen (such as an asphalt); cement; synthetic resins and rubber. The amount of the binder is also not limited and is adjusted to obtain sufficient binding of aggregates and to maintain prescribed void fraction. Usually the amount of the binder will vary depending on such conditions as particle size of the aggregate, the desired void fraction and kind of binder, and, therefore, is not limited. However, when an aggregate of bulk density of 0.2 g/cm$^3$ is employed, 100 to 500 parts by weight of binder based on 100 parts by weight of the aggregate are preferred. Fine adjustment of the void fraction can be achieved by controlling pressure on molding.

Furthermore, the bulk density of the first and third layers 2, 3 should be from 0.1 to 2.0 g/cm$^3$, preferably from 0.2 to 1.0 g/cm$^3$, and void fraction should be from 15 to 60%, preferably 20 to 40%. Bulk density of the first and the third layers is peferably of a range described above, since said layers are made of aggregates of light weight and the sound-proofing structure of the present invention should be a material of light weight. When the void fraction constitutes more than 60%, the mechanical strength is not sufficient and when the void fraction constitutes less than 15%, the sound-absorbing ability is insufficient.

In the present invention, the void means one formed between said aggregates. It is not a isolated void but connected with the other void.

In manufacture of the first 2 and third 3 layers, when an asphalt is used as a binder, an emulsion of the asphalt is prepared by mixing the asphalt and water, and the resulting emulsion and an aggregate are molded while mixed (molding conditions; atmospheric pressure, room temperature). Thereafter, a desired porous layer is obtained by evaporating water therefrom. It is possible to increase the bending strength and tensile strength of the layer by including an appropriate amount of filler such as powder of lime stone, glass fiber, asbestos or metal fiber to one or both of the first and third layers.

The aggregate and binder for the first 2 and third 3 layers can be arbitrarily chosen and both of them are not necessarily the same material. Thus, the most desirable material should be chosen by considering the intended use of the sound-proofing structure. For example, when the sound-proofing structure is used for a sound-proof wall, the binder of the first layer 2 should be a water repulsive binder such as an asphalt, and that of the third layer 3 should be a cement. When used as a flame-resistant construction material, the binder for both layers should be a cement.

The second layer 4 serves to adjust the frequency of sound to be absorbed, and thus it is comprised of a material having a quality to insulate relatively high frequency sounds and penetrate relatively low frequency sounds. The second layer 4 has the function of making a resonance absorption of high frequency mainly by the first layer 2, and allowing low frequencies which are not absorbed in the first layer 2 to penetrate therethrough to the third layer 3 and to then be absorbed by a resonance absorption at the third layer 3. Thus, an absorption of sounds of wide compass or range can be realized. Therefore, the structure of the second layer 4 is necessary to provide adjustment of the frequency of the sound to be absorbed. That is, in order to insulate high frequencies and to permit penetration of low frequencies, for example, a plastic sheet or cloth can be preferably used. These materials can control the frequency of the sound to be absorbed effectively by the vibration of the membrane formed thereby. When plates of plastic, asbestos cement, metal, etc., which provide relatively large penetration loss are used, these plates are made in the form of a perforated plate having a open area ratio(or porosity) of 0.01 to 0.5. Furthermore, it is possible for the second layer 4 to be made of the same material as for the first layer 2 and the third layer 3, but having greater density or smaller porosity. Moreover, a combination of the above-described materials is also possible.

It is also possible to change a resonance frequency by appropriate selection of the material for the second layer 4.

The thickness of each layer is dependent upon noise frequency, density and void fraction of the material. For example, when a frequency of from 400 to 1000 hertz is to be absorbed, the thickness of the first and the third layers 2, 3 is generally from 10 to 100 millimeters, respectively, and that of the second layer 4 is from 0.1 to 20 millimeters.

The fourth layer 1 is a material having a relatively high density and covering all surfaces of a laminate of the first, second and third layers except for the upper or outer surface of the first layer 2. Examples of the fourth layer 1 are sound-insulating materials such as metals and concrete. FIGS. 1 and 2 show the use of concrete as the fourth layer 1 and FIG. 3 shows the use of metal plate as the fourth layer 1'.

The sound-proofing structure of the present invention can be of any shape depending on intended use. For example, it can be readily formed as a block, panel, etc.

Another embodiment of the present invention illustrated in FIG. 10 is a structure wherein a perforated plate 5 is provided on the upper or outer face of the first layer 2 of the laminated structure with an air layer 6 interposed therebetween.

Structures described above exhibit very high sound absorption (80 to 100%) for noises of wide compass or range (100 to 4000 hertz). Therefore, the structures of the present invention are useful for preventing various types of noises. They can be used for side walls for highways, railways, etc., and sound-insulating materials for buildings.

This invention is described in more detail with the following illustrative Examples. As a method for the determination of sound absorption in the present invention, a reverberation room method is adopted.

EXAMPLE 1

The first and the third layers 2, 3, respectively, were prepared by using pearlite with a bulk density of 0.2 g/cm$^3$ and particle size of from 2 to 4 millimeters as an aggregate, and a blown asphalt with a penetration of 100 as binder. These were mixed and molded. Mixing ratio (by weight) was 200 or blown asphalt to 100 of pearlite. Thickness of the first layer 2 was 50 millimeters, and that of the third layer 3 was 40 millimeters.

The porous first and third layers thus obtained each had a bulk density of 0.35 g/cm$^3$ and void fraction of 30%.

Figure 4:
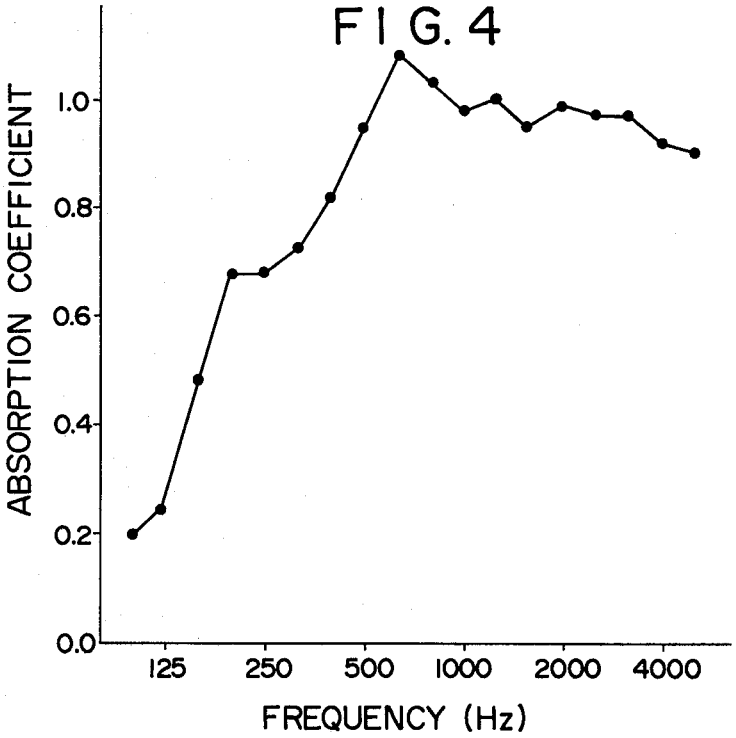

A polyethylene sheet with a thickness of 0.1 millimeter and covered with non-woven polypropylene (thickness 2 millimeters) on both sides is used as the second layer 4. The first 2, second 4 and third 3 layers were laminated in this order, and then they were made into a plate having a side length of 300 millimeters. Its sound-absorbing ability was then measured. The result is shown in FIG. 4.

EXAMPLE 2

Figure 5:
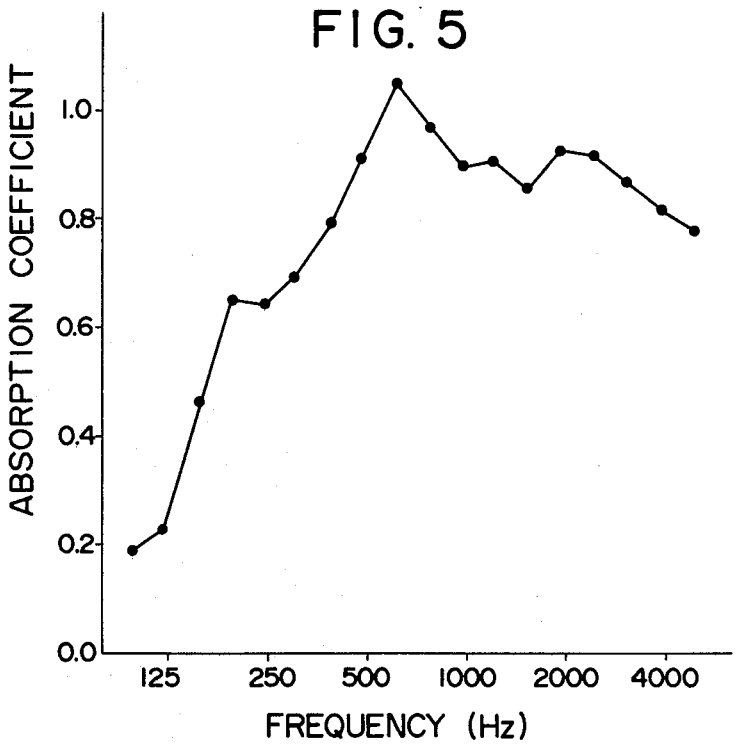
FIGS. 4, 5, 7, 8 and 9 are graphs showing sound absorption coefficients of the structures at various frequencies.
Figure 6:
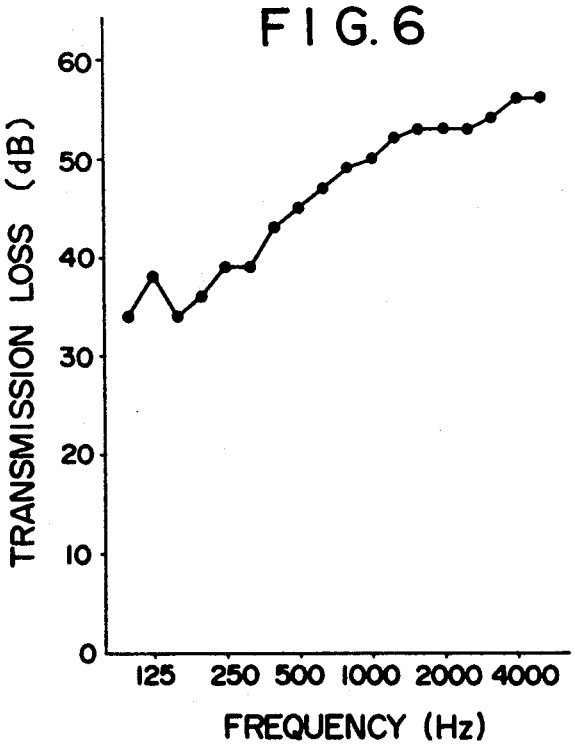
FIG. 6 is a graph showing permeation loss of the structure.

The first 2, second 4 and third 3 layers corresponding to those shown in Example 1 were laminated in this order and then they were placed in a square concrete block 1 (390 × 190 × 150 mm$^3$) whose inner and outer forms are square. The sound-proofing block thus obtained was subjected to measurement of the sound absorption coefficient. The results are shown in FIGS. 5 and 6.

EXAMPLE 3

Figure 7:
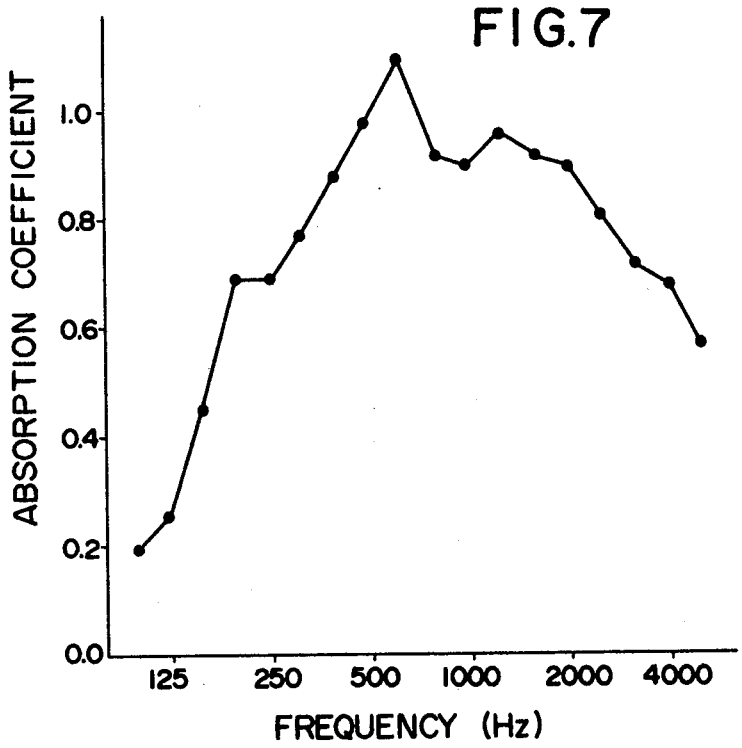

To the same structure as shown in Example 2, a perforated plate 5 (thickness, 4 millimeters; pitch, 15 millimeters; diameter of hole, 8 millimeters) was placed on the upper face of the first layer 2 with an air layer 6 of 30 centimeters interposed therebetween and the sound-absorbing ability of this structure was measured. The result is shown in FIG. 7.

EXAMPLE 4

Figure 8:
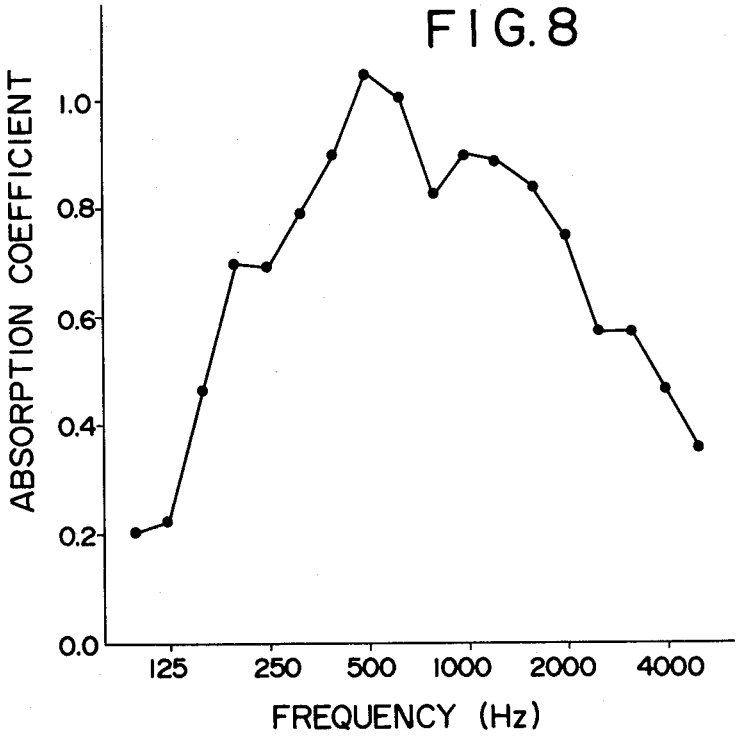

The same block structure as shown in Example 3 was fabricated except for a perforated plate 5 of different hole diameter. That is, a plate having a thickness of 4 millimeters, a pitch of 15 millimeters and a hole diameter of 5 millimeters was used. The sound absorption coefficient of the structure was measured. The result is shown in FIG. 8.

EXAMPLE 5

Aggregates for the first and third layers and the structure of the second layer was the same as described in Example 1. The binder for the first and the third layers was Portland cement. The mixing ratio (by weight) was 200 parts of Portland cement and 150 parts of water for 100 parts of the aggregate. After mixing them, they were molded. Thickness of the first and third layers was 45 millimeters and 40 millimeters, respectively. Bulk densities of both were 0.4 g/cm$^3$, and void fraction was 35%.

Figure 9:
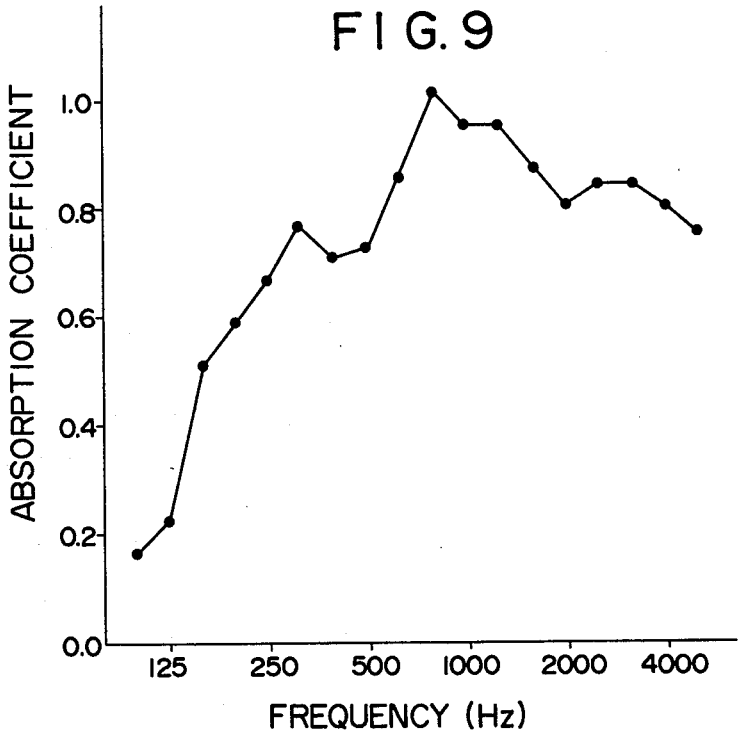

The first 2, second 4 and third 3 layers were laminated in this order and then placed in a square concrete block 1 (390 × 190 × 150 mm$^3$) whose inner and outer forms are square. The sound-absorbing ability of this structure was measured. The result is shown in FIG. 9.

We claim:

1. A multi layer sound-proofing structure for absorbing sounds having frequencies of from about 100–4000 Hz, comprising:

a first layer (2) comprising a light aggregate and a binder, having a bulk density of from 0.1 to 2.0 g/cm$^3$ and void fraction as continuous void of from 15 to 60%;

a second layer (4) on said first layer (2), said first layer having at least a major surface uncovered by said second layer so as to serve as an incident surface for sounds;

a third layer (3) on said second layer (4) with said second layer (4) interposed between said first and third layers, said third layer comprising a light aggregate and a binder, each of which is the same as or different from those of the first layer and having a bulk density of from 0.1 to 2.0 g/cm$^3$ and void fraction as continuous void of from 15 to 60%;

said second layer (4) being of a material having a quality to insulate relatively high frequency sounds and to permit penetration of relatively low frequency sounds; and a fourth layer (1) of a material having a high sound-insulating ability, and covering all free surfaces of the layered structure of said first, second and third layers except for said uncovered major surface of said first layer (2) such that said uncovered major surface of said first layer at least substantially defines the direct incident surface for sounds impinging on said sound-proofing structure.

2. The sound-proofing structure according to claim 1, wherein said light aggregate comprises at least one material selected from the group consisting of pearlite, synthetic light aggregates, pumice, volcanic gravel and vermiculite.

3. The sound-proofing structure according to claim 1, wherein said binder comprises at least one material selected from the group consisting of bitumen, cement, synthetic resin and rubber.

4. The sound-proofing structure according to claim 3, wherein the bitumen is an asphalt.

5. The sound-proofing structure according to claim 1, wherein the particle size of the light aggregate constituting said first and third layers is from 1 to 20 millimeters.

6. The sound-proofing structure according to claim 1, wherein the second layer (4) is made of one or more materials selected from the group consisting of cloth, a sheet, one which is a asbestos cement board or a plastic plate or a metal plate, having a open area ratio of 0.01 to 0.5, and a porous material which is the same as those constituting the first and third layers and which has a greater density or a smaller porosity.

7. The sound-proofing structure according to claim 1, wherein said fourth layer (1) is a concrete block whose inner and outer shapes are generally rectangular.

8. The sound-proofing structure according to claim 1, further comprising a perforated plate (5) on said major surface of said first layer (2) with an air layer (6) interposed therebetween.

9. The sound-proofing structure according to claim 1, wherein said first, second and third layers form a laminate structure.

* * * * *